US007497446B2

(12) United States Patent
Yang

(10) Patent No.: US 7,497,446 B2
(45) Date of Patent: Mar. 3, 2009

(54) ROLLER SHOES

(76) Inventor: Dong-Suk Yang, Dongnae Haits Villa 502, #391 Suan-dong, Dongnae-gu, Busan 607-050 (KR)

( * ) Notice: Subject to any disclaimer, the term of this patent is extended or adjusted under 35 U.S.C. 154(b) by 114 days.

(21) Appl. No.: 11/821,993

(22) Filed: Jun. 26, 2007

(65) Prior Publication Data

US 2008/0136126 A1 Jun. 12, 2008

Related U.S. Application Data

(63) Continuation-in-part of application No. 11/637,307, filed on Dec. 12, 2006, now abandoned.

(51) Int. Cl.
*A63C 17/00* (2006.01)

(52) U.S. Cl. ..... 280/11.27; 280/7.13; 280/7.1; 280/841; 280/8; 280/11.204

(58) Field of Classification Search ..... 280/11.27, 280/7.13, 7.1, 841, 8, 13, 11.19, 11.204
See application file for complete search history.

(56) References Cited

U.S. PATENT DOCUMENTS 3,306,623 A * 2/1967 Weitzner ..... 280/11.206
3,351,353 A * 11/1967 Weitzner ..... 280/7.13
4,363,502 A * 12/1982 Bakerman ..... 280/816
5,398,970 A 3/1995 Tucky
5,967,530 A * 10/1999 Chung ..... 280/11.19
6,364,322 B1 4/2002 Lee
6,386,555 B1 * 5/2002 Kao ..... 280/7.13
6,394,468 B1 5/2002 Chiang et al.
6,450,508 B1 9/2002 Chu
6,474,661 B1 11/2002 Chang
6,536,785 B2 3/2003 Lee
6,572,120 B2 6/2003 Chang
6,585,273 B2 7/2003 Chiu
6,629,698 B2 10/2003 Chu
6,631,911 B2 10/2003 Chen et al.
6,634,656 B1 10/2003 Gervasoni
6,698,769 B2 3/2004 Adams et al.
6,739,602 B2 5/2004 Adams
6,764,082 B2 7/2004 Roderick (Continued)

*Primary Examiner*—Christopher P Ellis
*Assistant Examiner*—Cynthia F Collado
(74) *Attorney, Agent, or Firm*—Jordan and Hamburg LLP

(57) ABSTRACT

Roller shoes in which a roller is installed on a shoe base in a detachable manner comprises a plurality of roller installation grooves formed at the center of the shoe base, a roller axle support inserted into the roller installation grooves, wherein the roller is attached to the roller axle support by a magnetic force, a break mechanism formed at both ends of a middle portion of the front and utmost end of the rear of the shoe base, and a cover mounted in the roller installation grooves. A roller axle support groove formed at both ends of a U shape is inserted in the roller installation groove, and a roller installation part comprising the roller axle is inserted in the roller axle support groove for the roller to be installed in a detachable manner. The same structure of the roller installation part is formed in the middle portion of the front of the shoe base and the roller axle and the roller axle support of the roller installation part installed respectively at the front and rear of the shoe base are adamantly coupled by a magnetic force.

7 Claims, 10 Drawing Sheets

U.S. PATENT DOCUMENTS

| | | | | |
|---|---|---|---|---|
| 6,913,269 | B2 | 7/2005 | Wang | |
| 6,913,270 | B2 | 7/2005 | Wang | |
| 6,926,289 | B2 | 8/2005 | Wang | |
| 6,979,003 | B2 | 12/2005 | Adams | |
| 7,036,829 | B2 | 5/2006 | Maxwell et al. | |
| 7,165,773 | B2 | 1/2007 | Adams | |
| 7,165,774 | B2 | 1/2007 | Adams | |
| 7,175,187 | B2 | 2/2007 | Lyden | |
| 7,407,167 | B1 * | 8/2008 | Chou | 280/7.13 |

* cited by examiner

ROLLER SHOES

This is a Continuation-in-part, of application Ser. No. 11/637,307 filed Dec. 12, 2006.

BACKGROUND OF THE INVENTION

A roller shoes is that the roller is installed on the shoe base in a detachable manner. A conventional roller shoes is constructed by that the roller installation groove is formed at the center of the rear of the shoe base, and a U shaped roller axle support, in which roller axle support grooves are formed at both sides thereof, is inserted and fixed into the roller installation groove. In addition, the roller rotates at the center of a roller.

Axle is engaged with the roller axle support and fixed at the shoe base. Further, the roller axle support is extruded from synthetic resin material.

Such conventional roller shoes can be used as general shoes and as roller shoes as well. That is, when the roller is not inserted into the roller shoes, this can be used as sole shoes, while when the roller is inserted into the roller installation groove on slope, this can be used as roller shoes.

The conventional roller shoes has a drawback in that since the roller axle of the roller is not confined in the roller axle support groove, which is open in semi-circular shape, and loosely inserted thereinto, and when a heel of the shoe is moved up, the roller axle is derailed from the roller axle support groove, and therefore the roller is deviated from the roller installation groove.

Moreover, since only one roller is mounted in rear of the shoe base, it is not possible to drive on plane earth as a roller skate, and a driving force per se such as mounting an ascending slope can not be obtained.

The previous structure of the roller is that the core and the tire are made as one body. That is, a plurality of stoppers are protrusively molded around the core. Such molded core is put into a casting mold to be connected with the tire, followed by introducing a fluid material of tire to be molded as one body. Thus, the stoppers are protrusively formed around the core such that, when the roller rotates, a slip in between the core and the tire can be prevented by the stoppers.

However, when the tire is used to a certain extent of time, it gets heated due to its friction against the ground and gets expanded. And the tire differs from the core in their coefficient of expansion by the difference in their material, thereby creating a gap in an abutment of the core and the tire.

In this case, the stoppers can prevent the slip i.e., derailment in a rotating direction, whereas they cannot perfectly prevent the slip in a direction along the roller axle.

U.S. Pat. Nos. 6,536,785 (Lee), 6,476,661 (Chang), 6,629,698 (Chu), 6,585,273 (Chiu), 6,572,120 (Chang), 6,631,911 (Chen et al.), 6,913,270 (Wang), 6,926,289 (Wang), and 6,913,269 (Wang) disclose a multifunctional roller skate, but those inventions are made of lot of metal parts. So they will get rusted from air moisture and ground water in a short time, thus having a short life-time. And the wheels are put into the midsole of the shoe base and, therefore, the wheels become very small, not leading to a fast running by free skating.

In case their invention is used as a running skate and if they have to use their roller as big as ours in size, the space to put the rollers into and to have other device for the rollers will become so big that the height of the midsole of the shoe becomes as high as women's high heel shoe, almost 80 mm high. And so their shoes bottom will be twice higher than ours, which is impossible to be used.

Adam's U.S. Pat. Nos. 6,979,003, 7,165,773, and 7,165,774 have 1 or 2 wheels only at the rear heel side. So they can run a short distance only by inertia force.

Further, the wheels are fixed. No convertible way to pull out the wheels for use as a normal shoe and to put them into use as a roller-shoe does exist. There is no brake. Therefore, it is very risky to run or to stop on a slope.

They can use their invention having the fixed wheels only for the purpose of normal shoe. So this can easily create a medical problem on ankle. Their cover over the roller is added onto the outsole, thereby making the outsole's rear area much higher. This also creates a medical problem on ankle.

In an embodiment of this invention, the height or the surface of the out sole of the shoe does not change, but maintain the same flatness even "with" or "without" the cover.

References Cited
U.S. Patents

| | | |
|---|---|---|
| 5,398,970 A | March 1995 | Tucky |
| 6,364,322 B1 | April 2002 | Lee |
| 6,394,468 B1 | May 2002 | Chiang et al. |
| 6,450,508 B1 | September 2002 | Chu |
| 6,476,661 B1 | May 2002 | Chang |
| 6,536,785 B2 | March 2003 | Lee |
| 6,572,120 B2 | June 2003 | Chang |
| 6,585,273 B2 | July 2003 | Chiu |
| 6,629,698 B2 | October 2003 | Chu |
| 6,631,911 B2 | October 2003 | Chen et al. |
| 6,634,656 B1 | October 2003 | Gervasoni |
| 6,698,769 B2 | March 2004 | Adams et al. |
| 6,739,602 B2 | May 2004 | Adams |
| 6,764,082 B2 | July 2004 | Roderick |
| 6,913,269 B2 | July 2005 | Wang |
| 6,913,270 B2 | July 2005 | Wang |
| 6,926,289 B2 | August 2005 | Wang |
| 6,979,003 B2 | December 2005 | Adams |
| 7,036,829 B2 | May 2006 | Maxwell et al. |
| 7,165,773 B2 | January 2007 | Adams |
| 7,165,774 B2 | January 2007 | Adams |
| 7,175,187 B2 | February 2007 | Lyden |

SUMMARY OF THE INVENTION

The present invention relates to a roller shoes in which a roller 2 is installed on a shoe base 1 in a detachable manner. More specifically, the present invention is directed to a roller shoes, which comprises a plurality of roller installation grooves 3 being formed at the center of the shoe base 1, a roller axle support 4 being inserted into the roller installation grooves 3, wherein the roller 2 is attached to the roller axle support 4 by a magnetic force, a break means 6 being formed at both ends of middle portion of the front and utmost end of the rear of the shoe base 1, and a cover 7 being mounted in the roller installation grooves 3.

According to the present invention, provided is a roller shoes in which a roller installation groove 3 is formed at the center of the middle portion of the rear of a shoe base 1, a roller axle support 4, in which a roller axle support groove 8 is formed at both ends of a U shape, is inserted in the roller installation groove 3, and a roller installation part comprising the roller axle 9 being inserted in the roller axle support groove 8 for the roller 2 to be installed in a detachable manner, wherein the same structure of the roller installation part is formed in the middle portion of the front of a shoe base 1; and the roller axle 9 and the roller axle support 4 of the roller installation part installed respectively at the front and rear of the shoe base 1 are adamantly coupled by a magnetic force.

DESCRIPTION OF THE PREFERRED EMBODIMENTS

Figure 1:
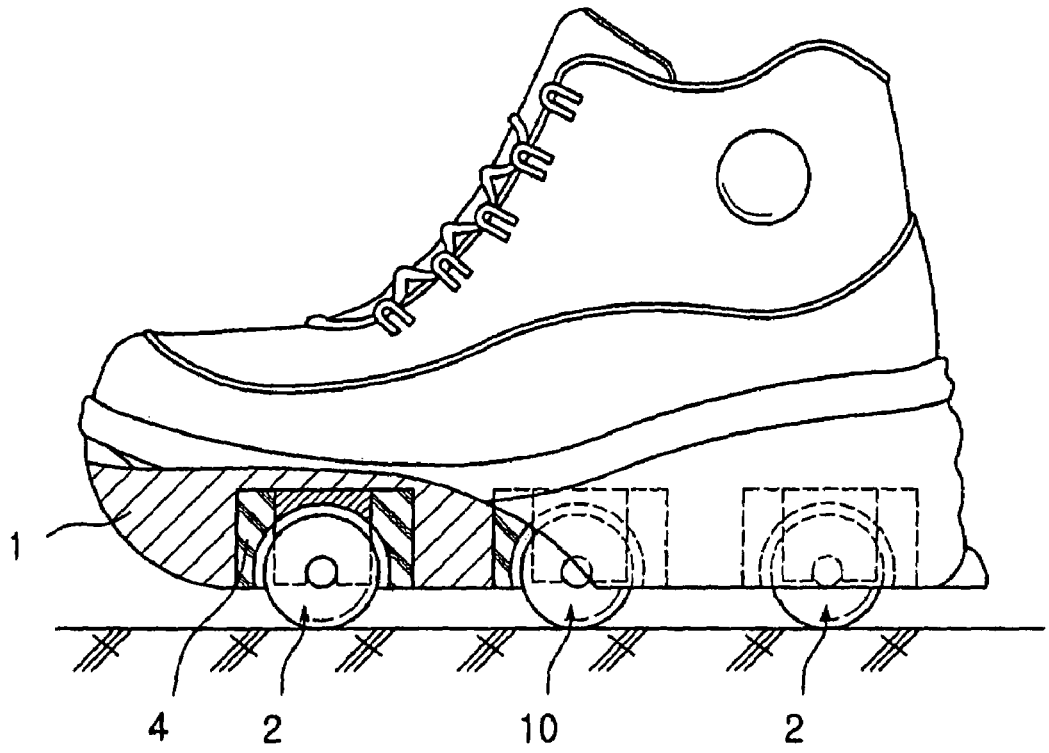
FIG. 1 is a view cutting the principal part of the present invention.

The present invention relates to a roller shoes in which a roller 2 is installed on a shoe base 1 in a detachable manner. More specifically, the present invention is directed to a roller shoes, which comprises a plurality of roller installation grooves 3 being formed at the center of the shoe base 1, a roller axle support 4 being inserted into the roller installation grooves 3, wherein the roller 2 is attached to the roller axle support 4 by a magnetic force, a break means 6 being formed at both ends of middle portion of the front and utmost end of the rear of the shoe base 1, and a cover 7 being mounted in the roller installation grooves 3.

Thus, such a construct provides easy assembly and disassembly of the roller 2, makes it possible to use as a general shoes by putting a cover 7 onto which the roller 2 is disassembled, and enhances the safety when driving the roller.

Accordingly, an object of the present invention is to solve at least the problems and disadvantages of the background art, which provides a structure in that the roller axle 9 of the roller 2 is inserted into the roller axle support groove 8 such that it can be attached thereto by a magnetic force.

Another object of the present invention is to provide a roller shoes that the roller installation grooves 3, as such structure in which the roller axle 9 of the roller 2 is not deviated from the roller axle support groove 8, are formed at the front and rear portion of the shoe base 1, respectively, thereby enabling the roller shoes to be used with roller skate.

Still another object of the present invention is to provide a roller shoes that when the roller is used as general shoes, it can be easily deviated from the roller installation groove 3, to which a cover 7 may be attached.

Still further object of the present invention is to provide a roller shoes that to solve the problem in the deformation of the shoe such as bending for the weakness of rigidity of the shoe base, when two rollers 2 are installed in the front and rear portion of the roller shoes, another auxiliary roller 10 is installed in between the two rollers 2, wherein the width of the auxiliary roller 10 may be smaller than that of the roller 2 installed in the front and rear portion of the shoe base to make it easy to convert the directions as when only two rollers are installed in the front and rear portion of the shoe base.

Still another object of this invention is to provide a roller shoe which can be used also as a normal shoe after its roller 2 being pulled out easily, with the cover 7 attached thereon.

In the structure of the two rollers 2 at the front and rear portions, the shoe base can be often bent or deformed if the base is not rigid enough. In order to improve this problem, one more third auxiliary wheel 10 is designed to put in between the front and rear rollers 2 which has a narrower width of the tread so that the running-turn by the consumer can be same easily made as when it has the front and rear rollers 2 only.

Also the purpose of this design is to create a structure which can prevent the core 12 and the tire 13 of the roller 2 from slipping out of in position, especially preventing the core's 12 separation along the horizontal direction of the roller axle 9 from the tire 13, by molding the core 12 with ring-shaped protrusion 15, thus enhancing the attachment strength with the tire 13.

And also the purpose of this design is to create a new structure of two rollers 2 of front and rear portions by adding a chassis 16 so that this can combine the two rollers 2 therein help the two rollers' 2 to be pulled easily out of the shoe-base 1, prevent the rollers 2 from being lost and secure a safe and easy storage when not used.

A roller shoes is constructed such that a roller installation groove 3 is formed at the center of the rear portion of a shoe base 1, support grooves 11 are additionally formed at both sides of the roller installation groove 3, respectively, and a U shaped roller axle support 4 is inserted across the roller installation groove 3 and the support groove 11 thereof. Roller axle support grooves 8 are formed at both ends of the roller axle support 4. A roller 2 is inserted into the roller installation groove 3, and an outwardly protruded roller axle 9 situated at the center of both sides of the roller 2 is installed in the roller axle support grooves 8 in a freely detachable manner.

The present invention, which modifies the above roller shoes, the same roller installation groove 3 is formed at the center of the front of the shoe base 1, and the roller 2 is installed thereto; and the same roller installation groove 3 is formed at the center portion of the shoe base 1, that is, predetermined portion between the two rollers 2 of the front and rear of the shoe base 1, and an auxiliary roller 10 is installed thereto. The roller 2 has the same structure as the auxiliary roller 10 does, but the width of the auxiliary roller 10 is smaller than that of the roller 2.

A hole is formed at the center portion of the ends of the roller axle 9 in the roller 2 and the auxiliary roller 10, and a magnet is inserted into the hole. The roller axle support 4 is made of metal materials, to which an attractive force is acted by the magnet 5.

Figure 4:
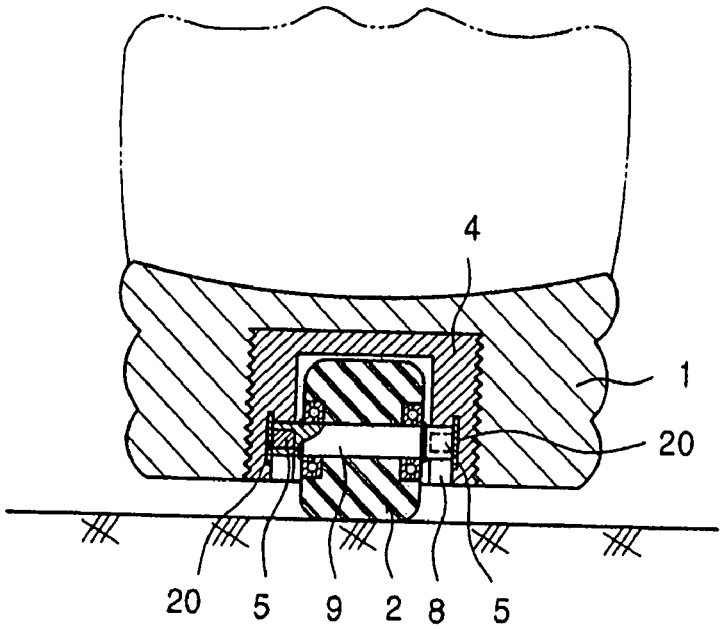
FIG. 4 is a sectional view illustrating one embodiment of the present invention.
Figure 5:
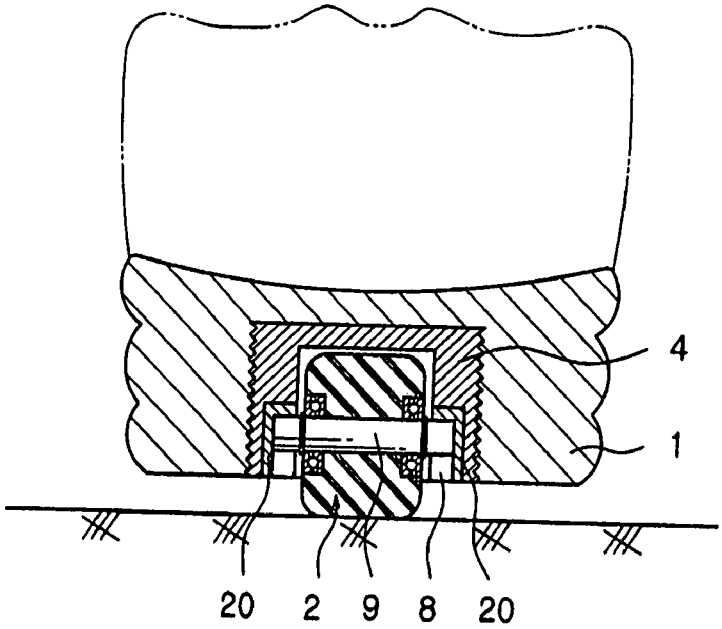
FIG. 5 is a sectional view illustrating another embodiment of the present invention.
Figure 6:
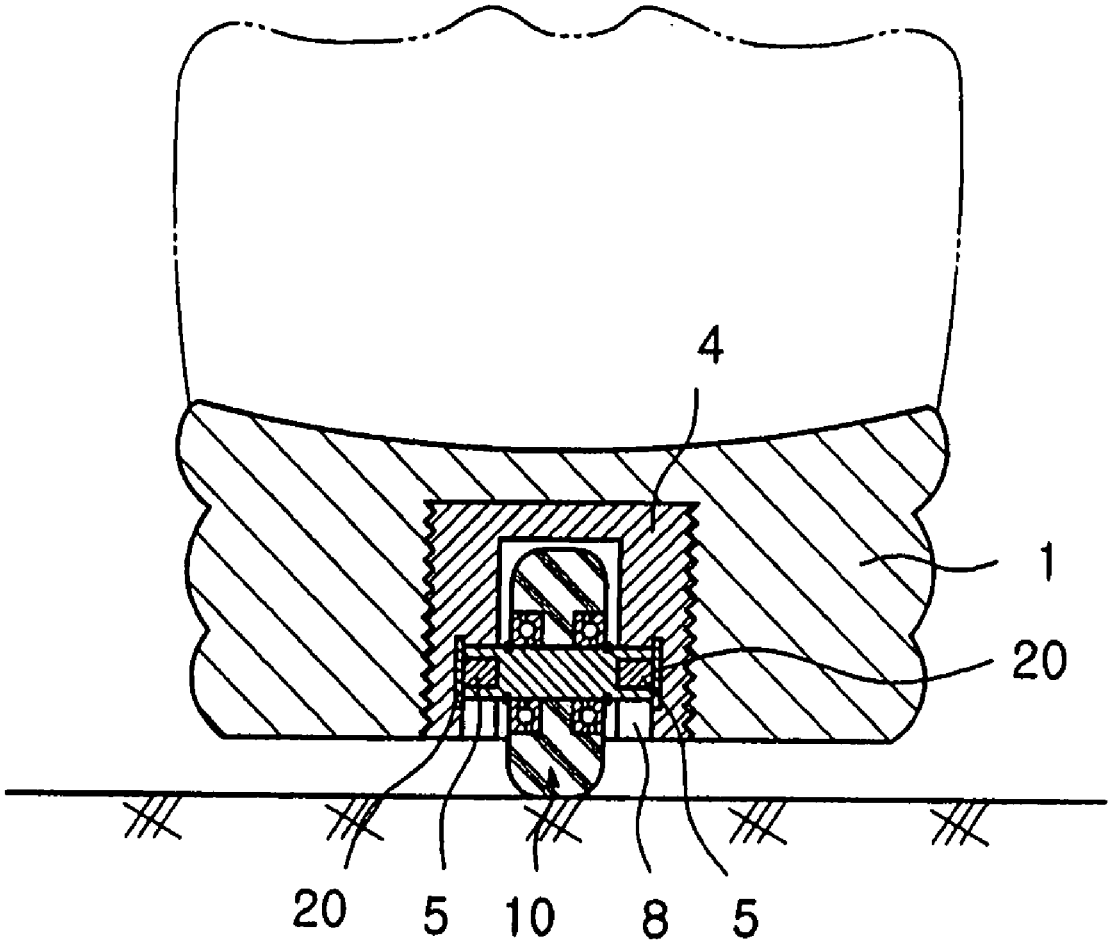
FIG. 6 is a sectional view illustrating an auxiliary roller being fixed according to the present invention.
Figure 7:
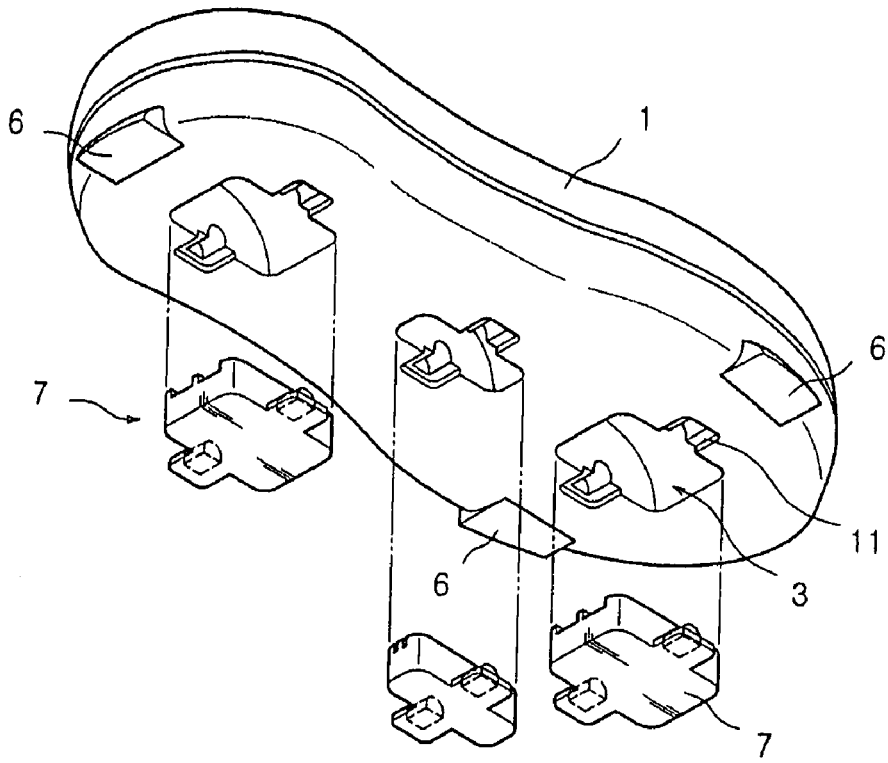
FIG. 7 is a perspective view illustrating the use of the present invention as general shoe.

In this structure, the roller axle 9, in which the magnet 5 is embedded, is coupled with the roller axle support 4 by its magnetic force. However, other embodiments are possible in that the roller axle support 4 can be made of metal materials having magnetic force such as the magnet, and simultaneously the roller axle 9 can be made of metal materials to which an attractive force is acted by the magnetic force of the roller axle support 4. As shown in FIGS. 4 and 6, when the roller axle support 4 is formed with a synthetic resin, etc., an iron piece 20 made of a metal, to which the magnet can be attached, is embedded inside the roller axle support 4, to which the magnet 5 installed in the roller axle 9 is contacted, such that the roller 2 or the auxiliary roller 10 can be secured therein by the magnetic force. Alternatively, as shown in FIG.

5, the iron piece 20 made of a metal, to which the magnet can be attached, may be installed in the roller axle support groove 8.

In addition, a wedge type of break means 6 are attached to both ends of the middle portion of the front and utmost end of the rear of the shoe base 1.

Figure 9:
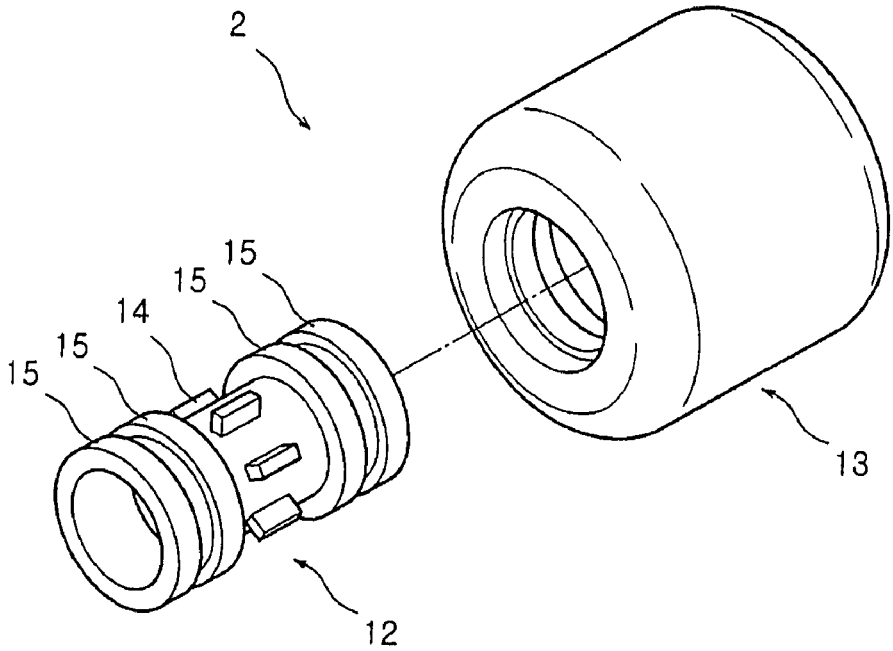
FIG. 9 is an expanded perspective view of a core and a tire in the roller.
Figure 10:
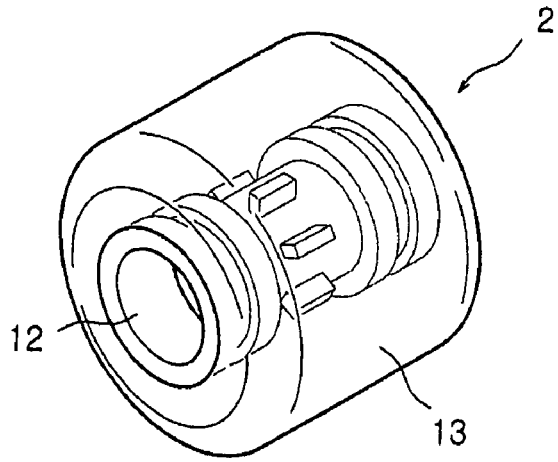
FIG. 10 is a perspective view showing a core and a tire formed as one body.
Figure 11:
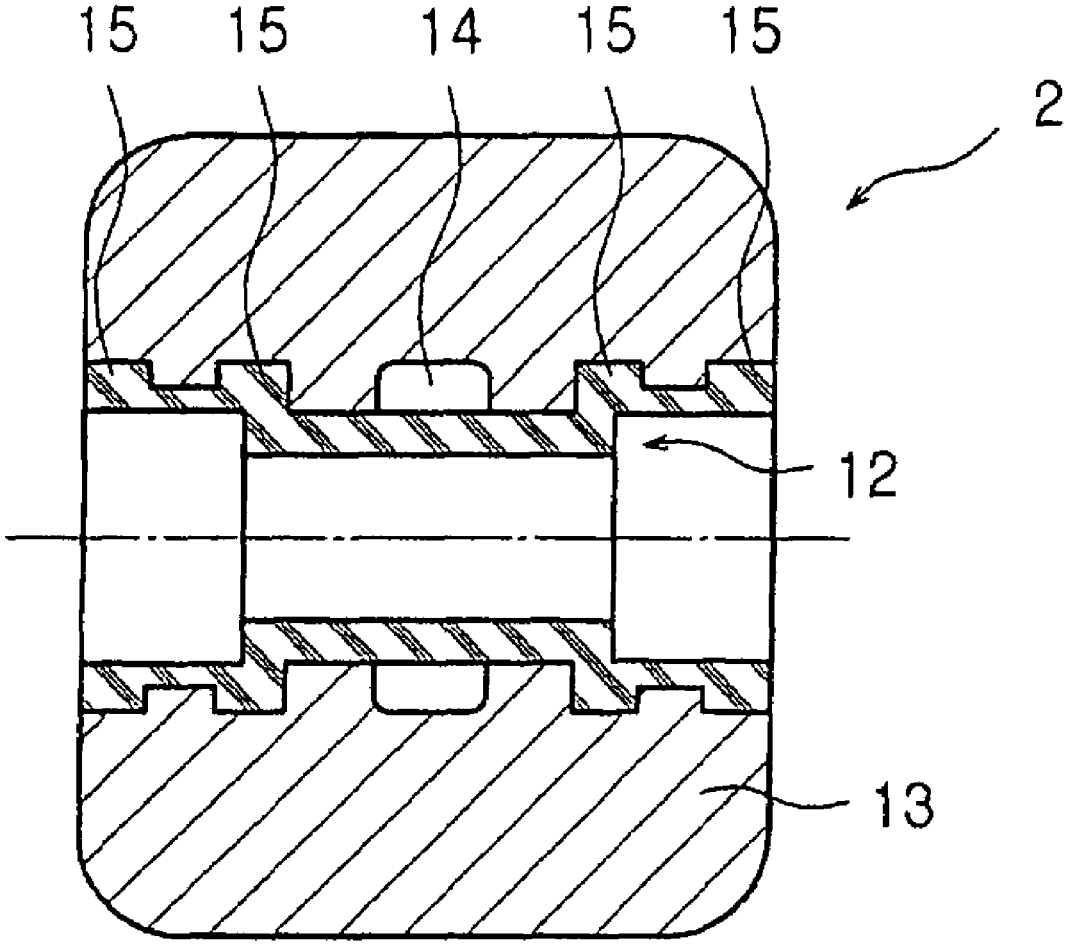
FIG. 11 is a sectional view of the roller.

And this is the structure which prevents the core 12 from separating with the tire 13. As shown in the FIGS. 9 and 11, this new design has not only the stoppers 14 of the previous core 12 but also at least one ring-shaped protrusion 15 on both end surface of the core 12.

Therefore, the new core's 12 stoppers 14 and ring-shaped protrusion 15 is buried inside the tire 13 for they are molded as one body.

Figure 12:
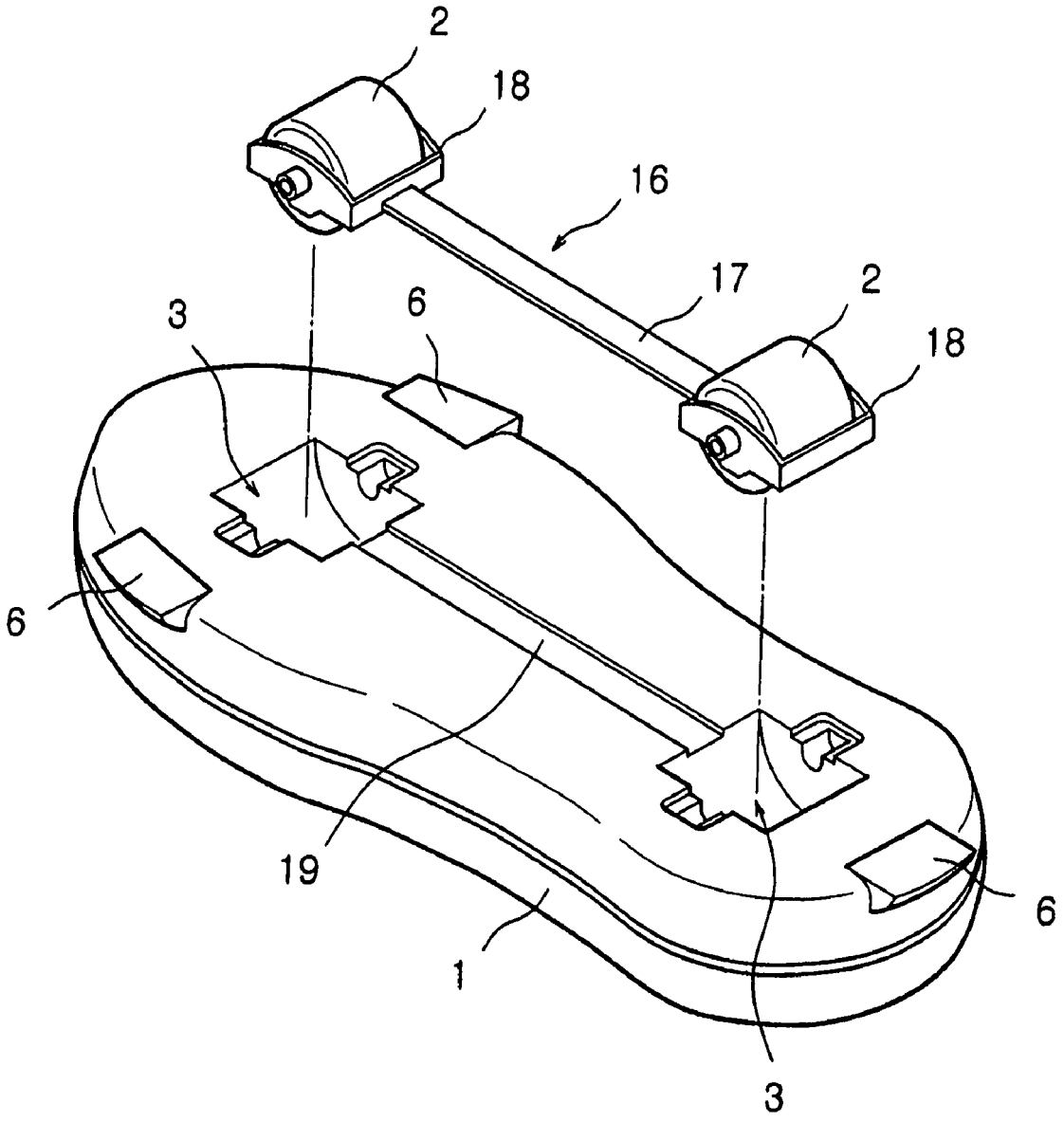
FIG. 12 is a perspective view showing a whole construction of chassis.

And this invention, as per the FIG. 12, the rollers 2 of front and rear portions are combined by the chassis 16 as one unit. This chassis 16 consists of a connection rod 17 which is as long as the distance between the two rollers 2 and of the two carriers 18 at both ends of the connection rod 17 into which the roller axle 9 of the rollers can be set.

For this chassis 16 to be positioned on the outsold 1, a groove 19 should be made with a depth as deep as the thickness of the connection rod 17.

And this design has wedge-shaped brakes 6 on the rear heel-end and on both side edges of ball-area of the outsole 1.

Further, covers 7 are prepared to blockade the plurality of the roller installation grooves 3 and the support groove 11 formed in the shoe base 1 by inserting type. Preferably, the cover 7 has its size and shape closely engaged with the periphery side of the roller installation groove 3 and the support groove 11.

This invention as a roller shoe with above explained structure is to attain the purpose of the invention by securing the below function.

The roller 2 of this invention is made by positioning the premolded core 12 into the metal casting mold and then by pouring the fluid resin into the casting mold around/over the core 12 and so by molding the tire 13 as one single unit with the core 12.

Accordingly the stoppers 14 prevent the core 12 from slipping along the rotating direction as well as the ring-shaped protrusion 15 prevent it from slipping along the horizontal shaft direction, and, therefore, the core 12 would not separate from the tire 13 even if it is used for a long time.

Figure 2:
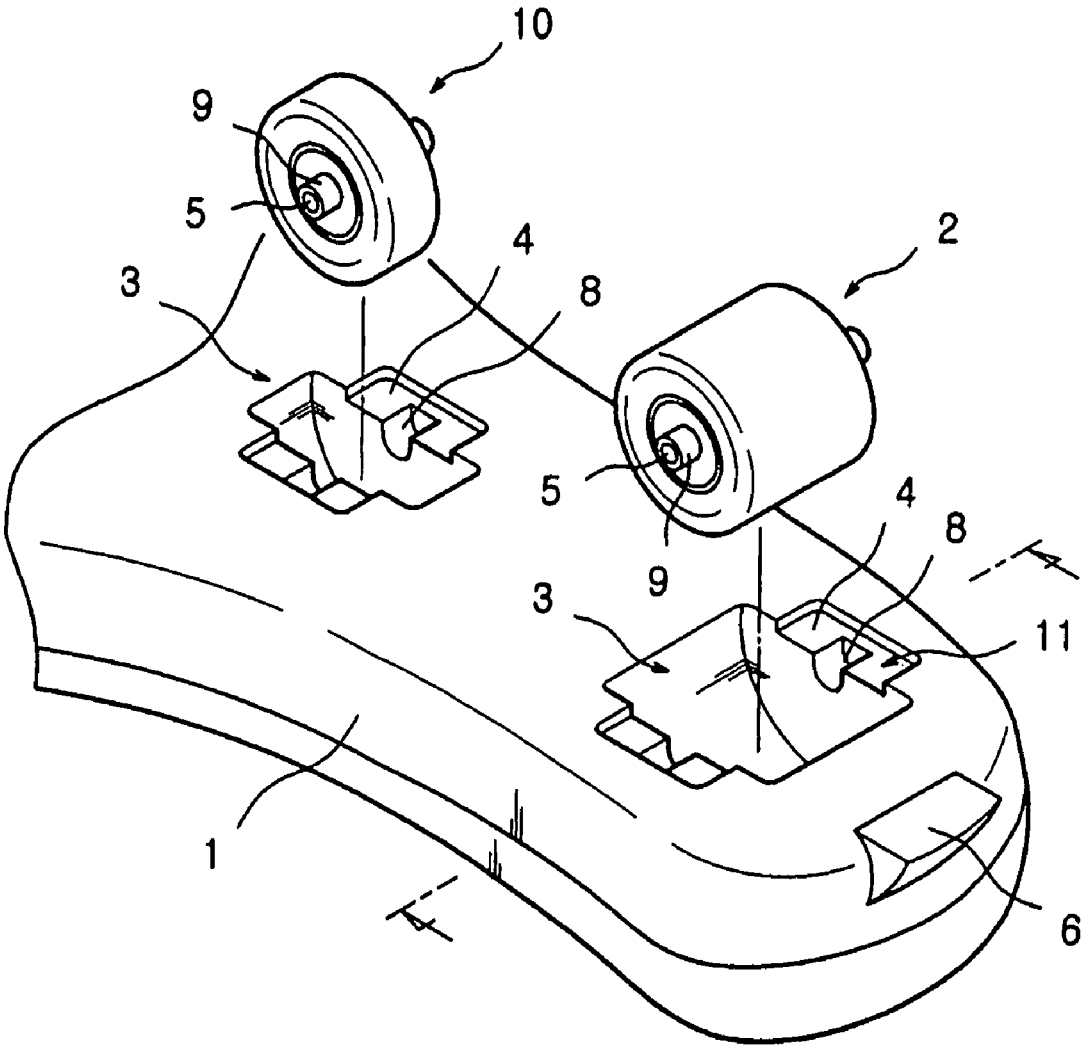
FIG. 2 is a perspective view illustrating the principal part of the present invention.
Figure 3:
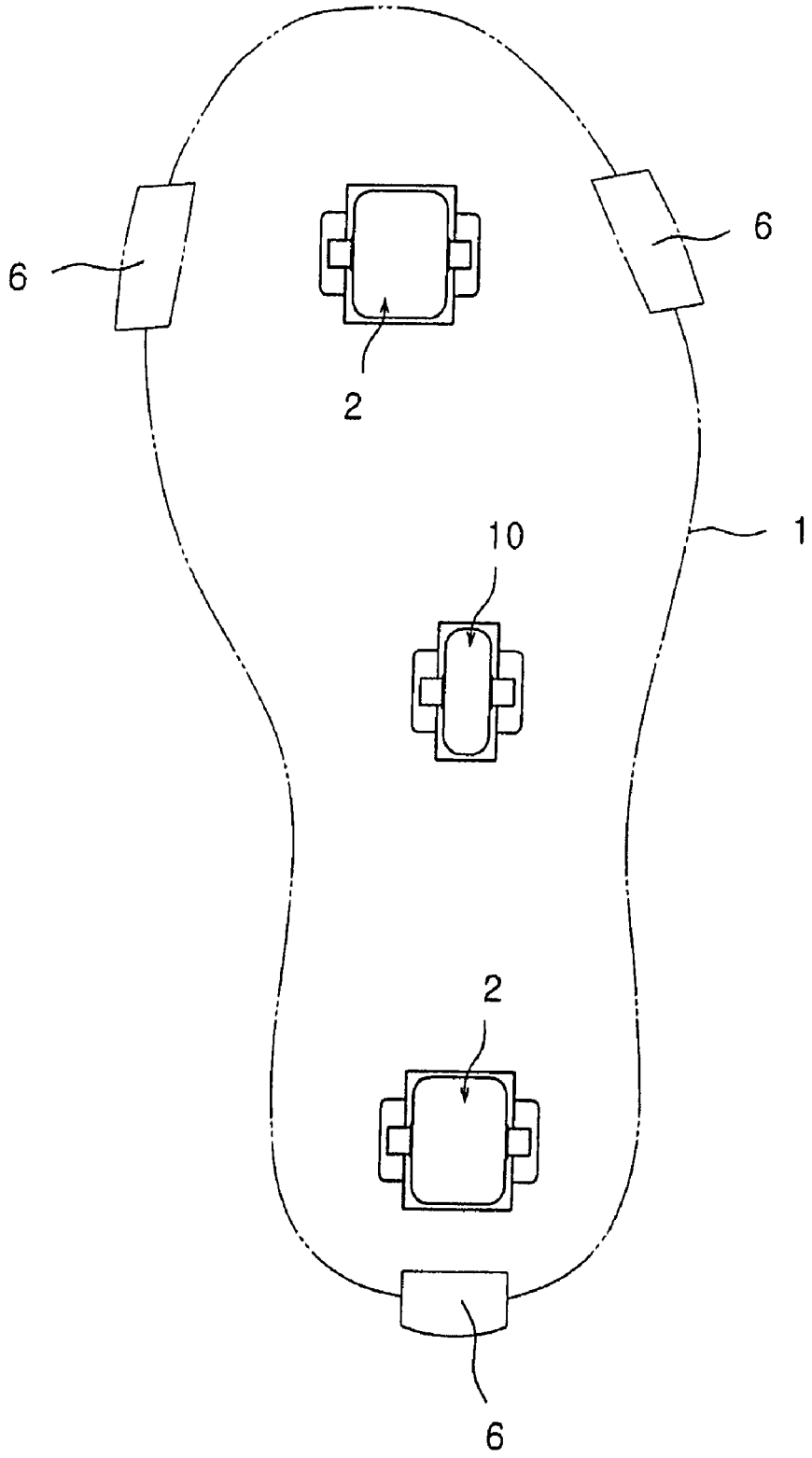
FIG. 3 is a view illustrating the bottom portion of the present invention.

The roller shoe of such construction is illustrated in FIGS. 1 to 3. On the base 1, the roller installation groove 3 is inlaid and inside thereof, at its both sides, there are roller axle support 4 of the roller axle 9 and this supporter 4 is located lower than the surface of the outsole which forms a depth 11 of the roller axle support 4.

Hereinafter, illustrative embodiments of the roller shoes in accordance with the present invention are described in more detail with reference to the accompanying drawings.

One embodiment of the roller shoes in accordance with the present invention, as depicted in FIGS. 1 to 3, a plurality of roller installation grooves 3 are formed in the shoe base 1. A U shaped roller axle support 4 is inserted in the roller installation groove 3, and both end portions of the roller axle support 4 are formed lower than the bottom surface of the shoe base 1, in which a support groove 11 is formed. The roller axle support 4 is molded with the shoe base 1 forming the roller installation groove 3 and the support groove 11 to connect each other. Molding connection portion may have an uneven surface to increase the connecting force, as shown in FIGS. 4 to 7.

The roller axle 9 is only to be inserted into the roller axle support groove 8 formed at both ends of the roller axle support 4 in order to fixate the roller 2 and the auxiliary roller 10 into the roller installation groove 3. Since the magnet is inserted in the roller axle 9, and the roller axle support 4 is made of metal such as steel iron acted by the attractive force of the magnet 5, or the iron piece 20 is installed inside thereof, when the roller axle 9 is inserted in the roller axle support groove 8, both are adamantly coupled by the magnetic force and not separated.

Alternatively, in another embodiment of the present invention, in case of the roller axle support 4 having a magnetic force and the roller axle 9 of metal material acted by the magnetic force, both are also adamantly coupled by the magnetic force.

Thus the magnet 5 constructed structure provides an easy detachment, and though the roller axle support groove 8 might be loosened, the connection can be maintained via the connecting force of the magnetic force. Therefore, even the bottom surface of the roller 2 is separated off the earth at certain interval to walk, the roller axle 9 is fixed in the roller axle support groove 8 by the magnetic force, thereby preventing the roller 2 from deviating from the roller installation groove 3.

In addition, since two pieces of the roller 2 and the auxiliary roller 10 are arranged in alignment, a driving force can be obtained by putting one foot at the earth, while pushing the other foot toward moving direction, such that it can provide running like a roller skate does.

Thus the present invention is structured such that one auxiliary roller 10 is installed in between the two pieces of roller 2 situated in the front and rear thereof, and therefore the roller shoes can behave to obtain the driving force like the roller skate. That is, since in the present invention, the two rollers 2 are installed at the bottom of the front and rear of the shoe base 1, the problems of the instability in the conventional roller shoes, e.g., since in the conventional roller shoes one piece of roller 2 is installed at the bottom of the rear of the shoe base 1, user have to raise the front portion of his or her foot to drive, can be overcomed, and therefore it is possible for the user to coast freely as the roller skate does.

Since the roller axle 9 is worn out continuously for its abrasiveness in the roller axle support groove 8 when the roller 2 and the auxiliary roller 10 are rotated, the roller axle 9 and the roller axle support 40 are preferred to be made of metal strong in the abrasiveness. Further, since the magnet 5 is weak in strength, hardness, and wear resistance, it is preferred to make a hole in the roller axle 9 and then to insert the magnet 5 thereinto.

Additionally, since the auxiliary roller 10 is installed, the present invention can prevent the bending of the shoe by the interval of the roller 2 of the front and rear of the shoe base 1. Particularly, the auxiliary roller 10 is preferred to be smaller than the roller 2 installed at the front and rear in width to prevent it from acting as resistance when rotating.

Figure 13:
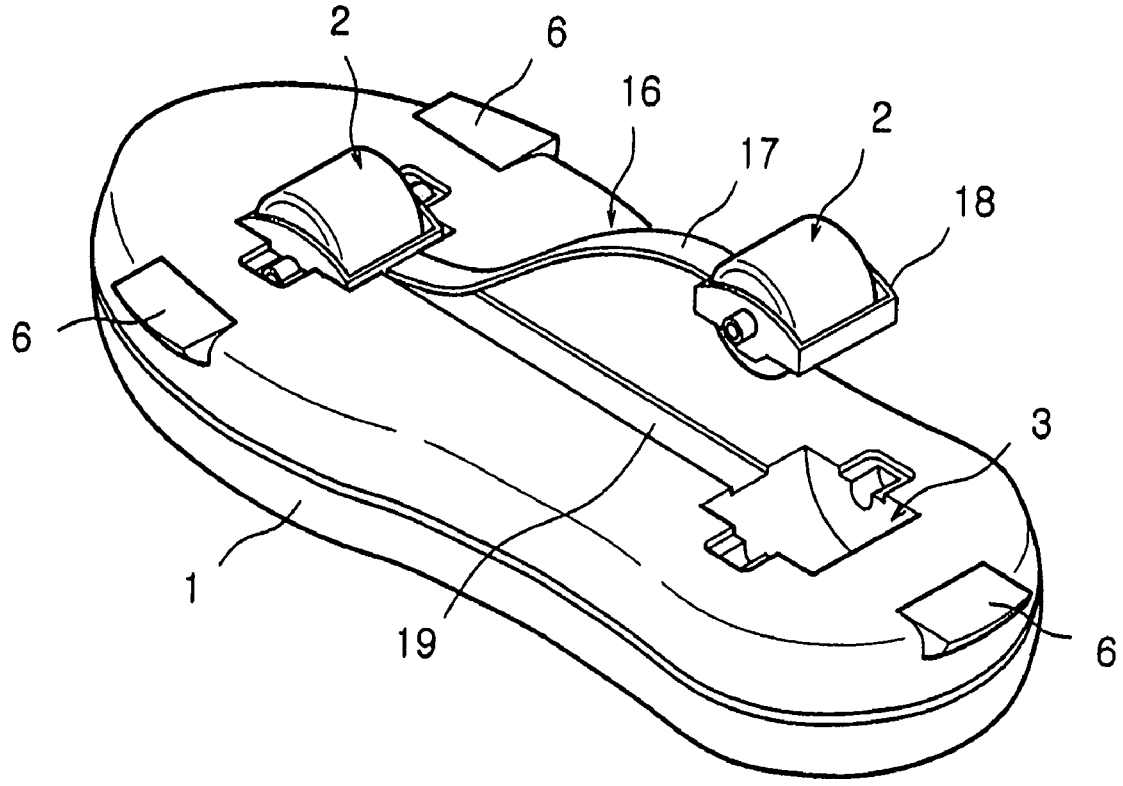
FIG. 13 is a perspective view showing a detachment of the roller using a chassis.

And this invention is for the chassis to combine the both rollers 2 as one unit. So as shown in FIGS. 12 and 13, it is very easy and convenient to put in and to pull out and prevent the rollers 2 from being lost when they are loose. That is, at both ends of the connection rod 17 there are carriers 18 which act as a hanger of the roller axle 9 and so, treating 1 unit of chassis has the same efficiency as treating two rollers 2 at the same time.

When putting in the rollers 2 by the chassis 16, as shown in FIG. 13, one roller 2 of one carrier 18 is set into the installation groove 3, and then another roller 2 can be set therein easily. And when pulling them out, if one roller 2 is pulled out, then another roller 2 which is on the carrier 18 at the other end of the connection rod 17 is pulled out easily at the same time.

Therefore the work of putting the rollers 2 into and pulling them out of the base 1 is much less and so the time is saved as such.

And when this invention is to be used as a normal shoe without the roller 2, the rollers 2 should be otherwise stored. In this case, instead of storing the individual rollers 2 which can roll away or can be lost easily, the chassis 16 with one roller 2 each at both ends can be stored in more convenience and safety.

When this chassis 16 is in use, the auxiliary roller 10 on the base 1 of the shoe may not be used or when the auxiliary roller 10 is used a connection rod 17 can be otherwise designed in such a way as not to touch the auxiliary roller 10.

Further, in the present invention, as depicted in FIG. 3, a wedge type of break means 6 are attached at both sides of the middle portion of the front and utmost portion of the rear of the shoe base 1. Therefore, when stopping during driving, it is possible to reduce the driving speed and to stop by raising the front portion of the shoe to contact the wedge type of break means 6 attached at the rear end of the shoe to the earth, or by inclining the shoe to either side to contact the wedge type of break means 6 attached at the left or right side end of the middle portion of the front of the shoe base 1 to the earth.

The roller shoes of the present invention can be also used only as general shoes. In this case, the roller 2 and the auxiliary roller 10 have only to be removed, and the roller installation grooves 3 have only to be closed. That is, when using as general shoes, the covers 7 are only put in the space in which the roller 2 have been installed after separating the roller 2 from the roller axle support 4.

Figure 8:
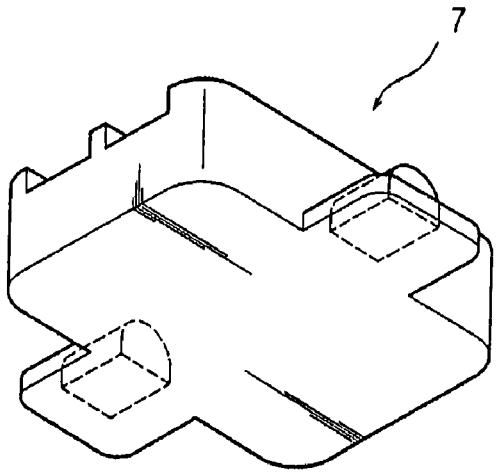
FIG. 8 is a perspective view illustrating a cover of the present invention.

The cover 7, as depicted in FIG. 8, has a shape and size enough to be closely inserted by pressure and coupled with the roller installation groove 3 and the support groove 11.

Thus in the present invention, each roller 2 is installed in the front and rear of the shoe base 1, and the auxiliary roller 10 is installed in between the rollers 2, thereby enable it to produce the driving force as the roller skate does, and to prevent the deformation of the shoe by the auxiliary roller 10 situated in the middle thereof.

In addition, the roller 2 and the auxiliary roller 10 are respectively coupled by the magnetic force, thereby preventing the deviation of the roller 2 and the auxiliary roller 10 when driving, and having advantage of easy detachment in converting it as general shoes.

When the core 12 and tire 13 is combined to a roller 2, with the several protrusion 15 on the surface of the core 12. The core 12 gets strongly combined and so there is no slip towards rotating direction and shaft direction, allowing no gap between core 12 and tire 13, and the tire 13 will not separate out of the core 12, even from a long time use.

And the roller 2 and auxiliary roller 10 have a construction that is set in by magnetic force, the roller 2 and the auxiliary roller 10 would not pop out while running. And when the invention is converted to a normal shoe, pulling out the rollers 2 is very convenient.

And the system of chassis 16 with rollers 2 fixed at both ends secures the work of putting-in and pulling-out to be done very quickly, and secures the convenience of storage and less risk of being lost.

Moreover, the break means 6 are attached at both side ends of the middle portion of the front and the rear end of the shoe base 1, thereby reducing the driving speed readily, and therefore it can ensure the safety when driving.

Further, the present invention can be used as roller skates in usual, and can be also used as general shoes by putting the cover 7 thereunder after removing the roller 2 and the auxiliary roller 10.

What is claimed is:

1. A roller shoes in which a roller installation groove is formed at the center of the middle portion of the rear of a shoe base, a roller axle support in which a roller axle support groove is formed at both ends of a U shape is inserted in the roller installation groove, and a roller installation part comprising the roller axle being inserted in the roller axle support groove for the roller to be installed in a detachable manner, wherein the same structure of the roller installation part is formed in the middle portion of the front of a shoe base and the roller axle and the roller axle support of the roller installation part installed respectively at the front and rear of the shoe base are adamantly coupled by a magnetic force.

2. The roller shoes as defined in claim 1, wherein the roller installation groove is formed in between the two roller installation part installed in the front and rear of the shoe base, the roller axle support in which the roller axle support grooves are formed at both ends of the U shape, and an auxiliary roller is formed such that the roller axle is inserted in the roller axle support groove.

3. The roller shoes as defined in claim 1, wherein wedge type of brake means are attached at both ends of the middle portion of the front and the utmost portion of the rear of the shoe base.

4. The roller shoes as defined in claim 1, wherein a cover, which is alternatively used with the roller and the auxiliary roller is installed in the roller installation groove.

5. The roller shoes as defined in claim 1, wherein the roller comprises a core in which a plurality of stoppers are formed there around and at least one protrusion is formed at both ends thereof, and a tire which is unitarily formed around the core.

6. The roller shoes as defined in claim 1, wherein two rollers installed in front and rear portions are configured to be mated with a chassis, said chassis comprising a connection rod having a length as the interval of the two rollers, and a carrier unitarily formed at both ends of the connection rod to thereby be mated with the roller axle inserted into the roller.

7. The roller shoes as defined in claim 2, wherein a cover, which is alternatively used with the roller and the auxiliary roller is installed in the roller installation groove.

* * * * *